US009672716B2

(12) United States Patent
Carroll

(10) Patent No.: US 9,672,716 B2
(45) Date of Patent: Jun. 6, 2017

(54) SWIM-A-SURE SYSTEM AND DEVICE

(71) Applicant: Clarke V Carroll, Bayport, NY (US)

(72) Inventor: Clarke V Carroll, Bayport, NY (US)

( * ) Notice: Subject to any disclaimer, the term of this patent is extended or adjusted under 35 U.S.C. 154(b) by 0 days.

(21) Appl. No.: 14/321,087

(22) Filed: Jul. 1, 2014

(65) Prior Publication Data

US 2016/0005292 A1 Jan. 7, 2016

(51) Int. Cl.

| | |
|---|---|
| ***G08B 21/08*** | (2006.01) |
| ***B63C 9/00*** | (2006.01) |
| ***B63B 45/00*** | (2006.01) |
| *G08B 5/00* | (2006.01) |
| *B63C 11/26* | (2006.01) |
| *G08B 21/02* | (2006.01) |
| *B63C 9/08* | (2006.01) |
| *B63C 9/13* | (2006.01) |
| *G08B 25/01* | (2006.01) |
| *G08B 21/10* | (2006.01) |

(52) U.S. Cl.

CPC ..... *G08B 21/088* (2013.01); *B63C 9/0005* (2013.01); *B63C 9/21* (2013.01); *G08B 21/08* (2013.01); *B63C 9/00* (2013.01); *B63C 9/08* (2013.01); *B63C 9/13* (2013.01); *B63C 11/26* (2013.01); *B63C 2009/0017* (2013.01); *G08B 5/002* (2013.01); *G08B 21/02* (2013.01); *G08B 21/10* (2013.01); *G08B 25/016* (2013.01)

(58) Field of Classification Search

CPC .... G08B 21/08; G08B 21/0451; G08B 21/02; G08B 5/002

USPC ..... 441/12; 340/539.28

See application file for complete search history.

(56) References Cited

U.S. PATENT DOCUMENTS

| | | | |
|---|---|---|---|
| 1,230,290 | A | 6/1919 | Geiger |
| 1,488,049 | A | 3/1924 | Lawless |
| 1,694,714 | A | 12/1928 | Markus |
| 2,197,324 | A | 4/1940 | Sommers et al. |
| 2,675,143 | A | 4/1954 | Seemann, Jr. |
| 2,937,387 | A | 5/1960 | Boynton, Jr. |
| 2,979,740 | A | 4/1961 | Walker et al. |
| 3,046,575 | A | 7/1962 | Davis et al. |

(Continued)

FOREIGN PATENT DOCUMENTS

WO WO2015087330 A1 * 12/2013 ..... B63C 11/08

OTHER PUBLICATIONS www.wahoosms.com.

*Primary Examiner* — Steven Lim
*Assistant Examiner* — Benyam Haile
(74) *Attorney, Agent, or Firm* — Lillie Law, LLC; James J. Lillie

(57) ABSTRACT

An interactive life system for increasing the safety of person in water having a base station configured to communicate with a remote node; the base station having a first controller having a first microcontroller; and a transceiver means; wherein the base station further includes an alert for alerting a monitor, a pager; a NOAA weather receiver; wherein the remote node comprises a second controller, a second transceiver, a GPS, a buoy, a panic button, a pressure transducer, a visual indicator, a vibrating motor, and a mount; wherein the second controller comprises a second microcontroller; wherein the panic button communicates with the base station; wherein the visual indicator includes light; wherein the vibrating motor includes a mechanical indicator; and where the monitee can wear the device on the wrist.

9 Claims, 6 Drawing Sheets

(56) References Cited

U.S. PATENT DOCUMENTS

| | | | | |
|---|---|---|---|---|
| 3,070,818 | A | 1/1963 | Fairchild | |
| 3,144,667 | A | 8/1964 | Dobbs | |
| 3,173,162 | A | 3/1965 | Elder, Jr. | |
| 3,510,895 | A | 5/1970 | Wynne | |
| 3,810,146 | A | 5/1974 | Lieb | |
| 3,890,662 | A | 6/1975 | Roberts | |
| 3,953,892 | A | 5/1976 | Kennedy et al. | |
| 4,184,216 | A | 1/1980 | Saleen | |
| 4,549,169 | A | 10/1985 | Moura et al. | |
| 4,629,436 | A | 12/1986 | Stewart et al. | |
| 4,662,850 | A | 5/1987 | Bostic, Sr. | |
| 4,747,085 | A | 5/1988 | Dunegan et al. | |
| 4,780,861 | A | 10/1988 | Stembridge et al. | |
| 4,810,219 | A | 3/1989 | Anderson et al. | |
| 4,813,899 | A | 3/1989 | Fujimoto | |
| 4,861,300 | A | 8/1989 | Casagrande et al. | |
| 4,968,277 | A | 11/1990 | Parish et al. | |
| 5,022,879 | A | 6/1991 | DiForte | |
| 5,049,859 | A | 9/1991 | Arnell | |
| 5,097,254 | A | 3/1992 | Merrithew | |
| 5,138,300 | A | 8/1992 | Chance | |
| 5,144,285 | A | 9/1992 | Gore | |
| 5,178,569 | A | 1/1993 | Wang | |
| 5,185,605 | A | 2/1993 | Roberts, Jr. et al. | |
| 5,241,923 | A | 9/1993 | Janning | |
| 5,374,212 | A | 12/1994 | Lall | |
| 5,408,222 | A | 4/1995 | Yaffe et al. | |
| 5,421,760 | A | 6/1995 | Blaga | |
| 5,456,623 | A | 10/1995 | Norris | |
| 5,504,474 | A | 4/1996 | Libman et al. | |
| 5,516,233 | A | 5/1996 | Courtney | |
| 5,518,430 | A | 5/1996 | Crowder et al. | |
| 5,543,780 | A | 8/1996 | McAuley et al. | |
| 5,619,187 | A | 4/1997 | Serfontein | |
| 5,669,795 | A | 9/1997 | Lahtinen | |
| 5,702,279 | A | 12/1997 | Brown | |
| 5,816,878 | A | 10/1998 | McNamee | |
| 5,823,840 | A | 10/1998 | Powers | |
| 5,855,454 | A | 1/1999 | Courtney et al. | |
| 5,879,213 | A | 3/1999 | Williams, Jr. et al. | |
| 5,907,281 | A | 5/1999 | Miller, Jr. et al. | |
| 5,945,912 | A | 8/1999 | Guldbrand | |
| 6,004,178 | A | 12/1999 | Liu et al. | |
| 6,008,727 | A | 12/1999 | Want et al. | |
| 6,056,613 | A | 5/2000 | Pike | |
| 6,081,194 | A | 6/2000 | Sanchez | |
| 6,089,403 | A | 7/2000 | Mackal | |
| 6,129,036 | A | 10/2000 | King et al. | |
| 6,154,140 | A * | 11/2000 | Thorpe | B63C 11/02 340/573.6 |
| 6,157,303 | A | 12/2000 | Bodie et al. | |
| 6,186,902 | B1 | 2/2001 | Briggs | |
| 6,203,246 | B1 | 3/2001 | Courtney et al. | |
| 6,260,570 | B1 | 7/2001 | Wass et al. | |
| 6,327,220 | B1 | 12/2001 | Miller, Jr. et al. | |
| 6,409,561 | B1 | 6/2002 | Ibasfalean | |
| 6,422,420 | B1 | 7/2002 | Brown | |
| 6,530,725 | B1 | 3/2003 | Courtney et al. | |
| 6,558,082 | B1 | 5/2003 | Courtney et al. | |
| 6,666,622 | B1 | 12/2003 | Courtney et al. | |
| 6,776,678 | B2 | 8/2004 | Courtney | |
| 6,805,519 | B1 | 10/2004 | Courtney | |
| 6,805,599 | B1 | 10/2004 | Huang | |
| 6,825,767 | B2 | 11/2004 | Humbard | |
| 6,951,493 | B1 | 10/2005 | Lu | |
| 7,018,257 | B2 | 3/2006 | Courtney | |
| 7,056,179 | B2 | 6/2006 | Courtney | |
| 7,178,547 | B2 | 2/2007 | Mackal | |
| 7,267,509 | B1 | 9/2007 | Jackson, III | |
| 7,336,182 | B1 | 2/2008 | Baranowski et al. | |
| 7,479,891 | B2 | 1/2009 | Boujon | |
| 7,497,784 | B2 | 3/2009 | Henry | |
| 7,546,815 | B2 | 6/2009 | Mazzei et al. | |
| 7,642,921 | B2 | 1/2010 | Cutler et al. | |
| 7,682,209 | B2 | 3/2010 | Huang | |
| RE42,238 | E | 3/2011 | Courtney et al. | |
| 7,918,701 | B2 | 4/2011 | Spinoza | |
| 8,016,627 | B2 | 9/2011 | Andrea et al. | |
| 8,162,365 | B2 | 4/2012 | Escobar | |
| 8,187,047 | B1 | 5/2012 | Brooks | |
| 2003/0068939 | A1 | 4/2003 | Ishihara | |
| 2003/0222782 | A1 | 12/2003 | Gaudreau | |
| 2004/0033740 | A1 | 2/2004 | Jones | |
| 2004/0095248 | A1 | 5/2004 | Mandel | |
| 2004/0157514 | A1 | 8/2004 | Courtney | |
| 2004/0196180 | A1 | 10/2004 | Hollis et al. | |
| 2005/0088916 | A1 | 4/2005 | Zhu et al. | |
| 2005/0101203 | A1 | 5/2005 | Kemp | |
| 2005/0120796 | A1 | 6/2005 | Nash et al. | |
| 2005/0200481 | A1 | 9/2005 | Wallach | |
| 2005/0221700 | A1 | 10/2005 | Weinel | |
| 2006/0034155 | A1 | 2/2006 | Etchenique | |
| 2006/0214805 | A1 | 9/2006 | Boujon | |
| 2006/0270290 | A1 | 11/2006 | Tellew | |
| 2006/0280034 | A1 | 12/2006 | Howard et al. | |
| 2007/0070814 | A1 | 3/2007 | Frodyma et al. | |
| 2007/0076527 | A1 | 4/2007 | Romano | |
| 2007/0080806 | A1 | 4/2007 | Lax et al. | |
| 2007/0132578 | A1 | 6/2007 | Powell | |
| 2007/0159332 | A1 | 7/2007 | Koblasz | |
| 2007/0159925 | A1 | 7/2007 | Chryssostomidis et al. | |
| 2007/0223313 | A1 | 9/2007 | Kimball | |
| 2007/0247359 | A1 | 10/2007 | Ghazarian | |
| 2008/0266118 | A1* | 10/2008 | Pierson | A61B 5/0205 340/573.6 |
| 2014/0241122 | A1* | 8/2014 | Ponceau | G01V 1/38 367/18 |

* cited by examiner

SWIM-A-SURE SYSTEM AND DEVICE

CROSS REFERENCE TO RELATED APPLICATIONS

None

BACKGROUND OF THE INVENTION

The invention relates to providing a Swim-A-Sure System and Device, including, inter alia, a system that enables an individual to be tracked voluntarily and/or involuntarily in an aquatic environment, in addition to providing means for deploying a safety device voluntarily and/or involuntarily.

PRIOR ART

A major concern for parents and legislators is the safety and well being of individuals that travel on, or over water, as well individuals that undertake activities in, on, or adjacent to bodies of water.

A device that comes to mind traditionally is a life preserver or life vest aka PFD (personal floatation device). Many a patent have addressed the ongoing clash between fashion and function, e.g., the device needs to provide sufficient floatation while providing the least amount of inconvenience to the operator, and it is indisputable that the controlling facet of the device's needs is whether the device sufficiently floats with the operator when in use. An array of references included in the information disclosure statement attempt to address this concern.

The disclosed devices have been designed for the wrist, the waist e.g., as in a belt, suspenders, collars, anklets, to name a few. See U.S. Pat. No. 1,694,714 to Peter Markus in 1927, which revolutionized the long used cork or wood vests used in Scandinavia and Europe in the 1800s.

Others have attempted to address issues for scuba divers or the like. For example, U.S. Pat. No. 6,805,519 appears to address the issue of a scuba diver or the like, that has been rendered unconscious.

Others seem to focus on scenarios in a pool or enclosed setting, such as that of the Wahoo Safe Monitoring System (see print out from website), has two preset periods of time for setting off escalating alerts, (1) yellow and (2) red; the product was idea born from a death of a fellow classmate of the three fathers' children. www.wahoosms.com. This product appears to use monitors/receivers on tripods that communicate with the headband worn by the swimmer; the first (yellow) alert is purely a visual yellow light set off by the headband, and the yellow light blinks on the tripod for the lifeguards to see; if the swimmer stays under long enough, the red light flashes, along with an audio alarm for all to see and hear; moreover, the life guard has a device that they can use to track the beacon in the headband. See also U.S. Pat. No. 7,642,921 to Colter et al.

However, all these devices fail to address the issue or provide a system and device that enables the swimmer to deploy the device unilaterally and/or enables a parent to deploy the device unilaterally remotely while the swimmer, such as a child, is experiencing difficulties remaining afloat in the body of water. As long as there continues to be drownings, especially of the children, there will be a long felt need to design superior ways to prevent loosing a child to drowning.

SUMMARY OF INVENTION

An objective of the present invention includes providing a system wherein a first person e.g., monitee can be monitored by a second person, e.g., monitor, when the first person is near a body of water and a risk of drowning is present.

Another objective of the present invention includes providing a system wherein a first person can self deploy a signaling system.

A still further objective of the present invention includes providing a system wherein a second person can deploy the system remotely for the benefit of the first person.

Another objective of the present invention includes providing a system wherein the system may be set to automatically deploy by either the first and/or second person.

An additional objective of the present invention includes providing a system that has proactive features prior to someone undertaking an activity thereby reducing the risk of drowning.

A still additional objective of the present invention includes providing a system that has reactive features once a person has undertaken an activity thereby reducing the risk of drowning.

A still further objective of the present invention includes providing a system that simultaneously interfaces a plurality of first persons per second person.

An objective of the present invention includes providing a system that communicates, inter alia, with a cell phone.

An objective of the present invention includes providing a system that communicates, inter alia, via Bluetooth™ technology.

Other objectives, advantages, and novel features of the present invention will become more apparent from the following detailed description when taken in conjunction with the accompanying drawings.

BRIEF DESCRIPTION OF THE DRAWINGS

The following drawings, in which like reference characters indicate like parts, are provided for illustration of the invention and are not intended to limit the invention in any manner whatsoever.

DETAILED DESCRIPTION OF INVENTION

Referring generally to FIGS. 1 to 5, herein below, illustrate an interactive life system 1 for increasing the safety of a person in or near a body of water. Swimmers, particularly in large bodies of water such as lakes or oceans, are at risk of drowning from a number of factors such as inexperience, fatigue, seizure, cardiac event, among a myriad of others; moreover, people that undertake activities adjacent to a body of water where there is a risk they might fall into the water, such as fishing off a pier or vessel, or bicycle riding about the body of water, etc. The present invention disclosed herein is intended to be portable as well as having the ability to support a plurality of monitees. The Wahoo system disclosed hereinabove requires infrastructure in the area of the swimmer to be in place whereas the current invention is intended more as a portable personal swimming safety system that can be setup quickly and packed up when all swimming activities are done.

Figure 1A:
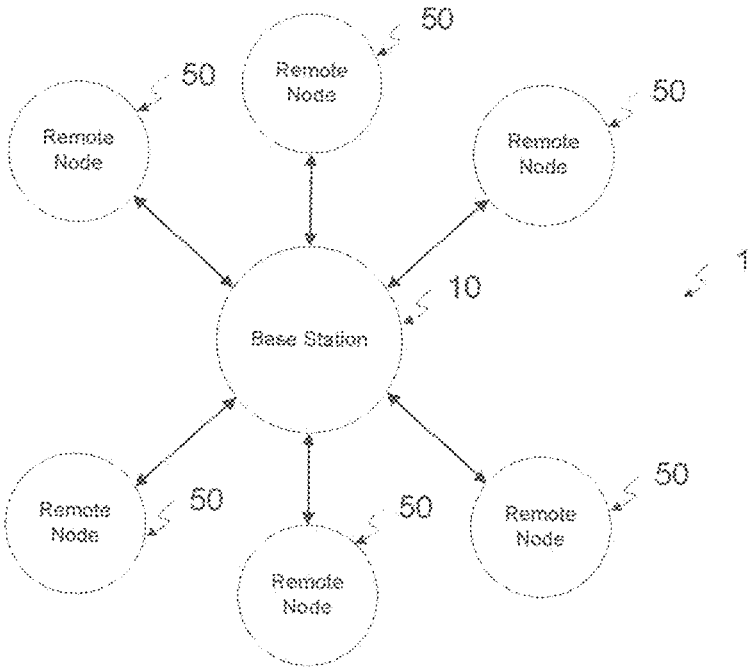
FIG. 1A illustrates a first system having a star relationship with the base station.
Figure 1B:
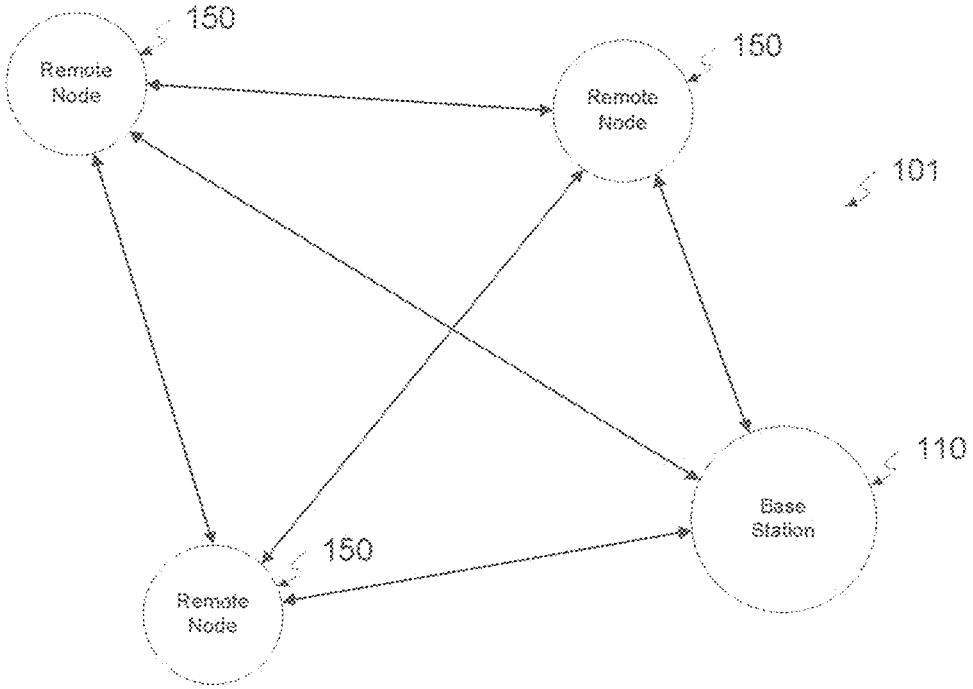
FIG. 1B illustrates an alternate system having a peer-to-peer relationship with the base station.

The system 1 includes a base station node 10 configured and dimensioned to communicate bi-directionally with a plurality of remote nodes 50 collectively referred to as a defined network. FIG. 1A illustrates a first system 1 having a star configuration (also known as a hub-spoke configuration), while FIG. 1B illustrates a second system 101, arranged in an alternate embodiment using a peer-to-peer configuration. In the first system 1, each remote node 50 communicates only with the base station 10 wherein the maximum separation between the base station 10 and remote node 50 is limited to the distance between the two in which reliable communication can be maintained. This distance may be affected by such factors as weather and physical location (e.g. sand dunes).

In the second system or arrangement 101, each remote node 150 may communicate with the base station 110, as well as with other remote nodes 150 that are part of the monitored network. In this embodiment, a remote node 150 may communicate with the base station 110 by relaying messages through a plurality of remote nodes 150 within the monitored network thus increasing the permissible separation distance between base station node 110 and farthest remote node 150.

Figure 2:
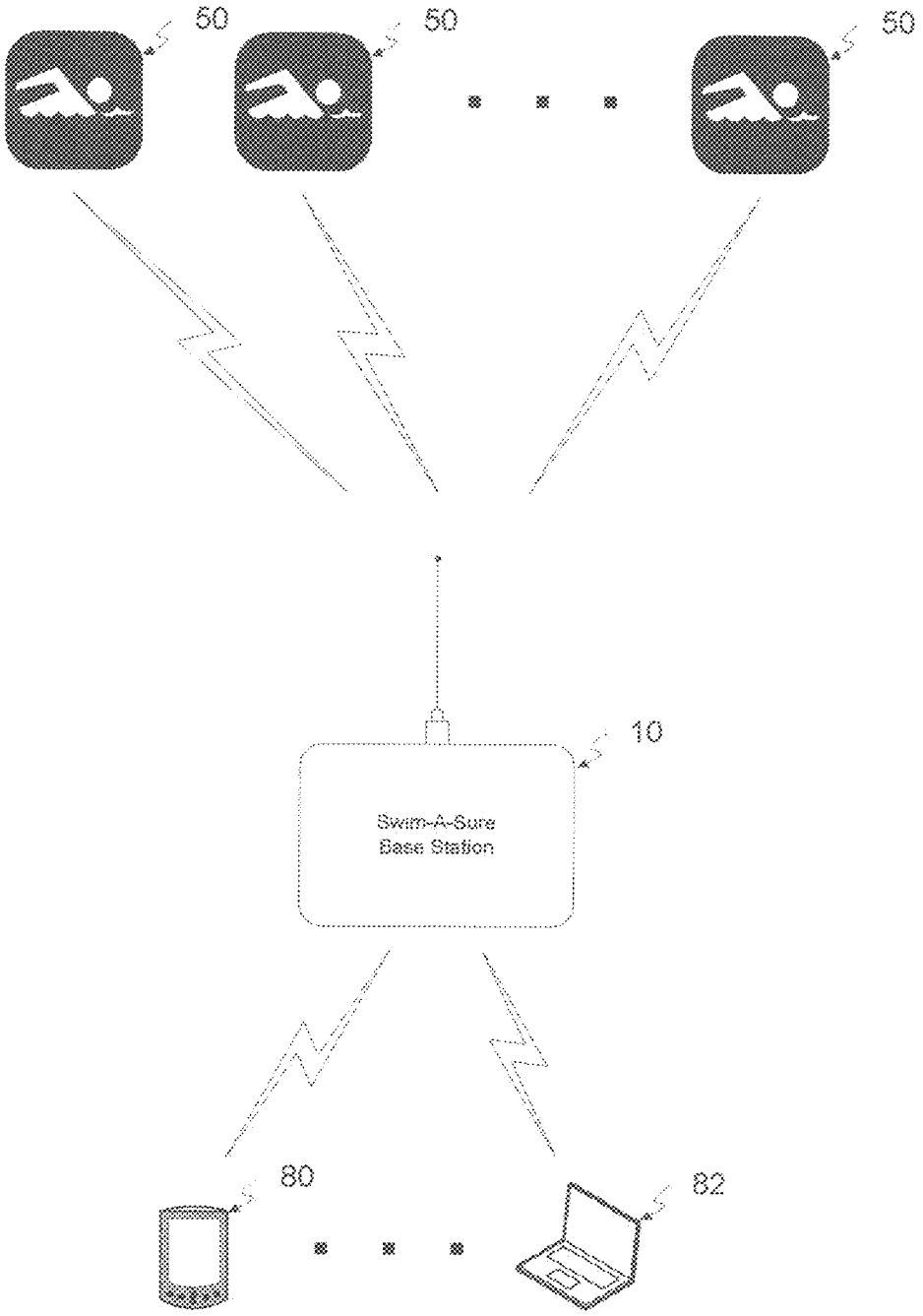
FIG. 2 illustrates a preferred embodiment of the present invention, wherein each monitee communicates directly with the base station.

In either embodiment, the use of the base station 10, to communicate with the remote nodes 50, does not require the use of any local infrastructure as the base station 10 contains the means necessary for monitoring the remote nodes 50. FIG. 2 illustrates how a plurality of remote nodes 50 can be configured and arranged to communicate with a single base station 10, and how the base station 10 can be configured to communicate with a personal communication device (such as an individual's cell phone, tablet, phablet) 80, and/or laptop 82 for configuring and/or monitoring a network of remote nodes 50.

The present invention does not rely on the personal communication device 80 and/or laptop 82 for monitoring operation. While Wi-Fi and cell phones seem to be ubiquitous these days, having Wi-Fi and/or cell phone service is not always assured, particularly in more remote locations or rural areas. This makes any safety system that solely relies on a personal communication device 80 and/or laptop 82 a poor choice for the basis of a monitee's safety system. The current invention only incorporates the personal communication device 80 and/or laptop 82 as a convenient man-machine interface (MMI) for configuring and optional monitoring of the invention and does not require Wi-Fi and/or cell phone service for operation.

Figure 3:
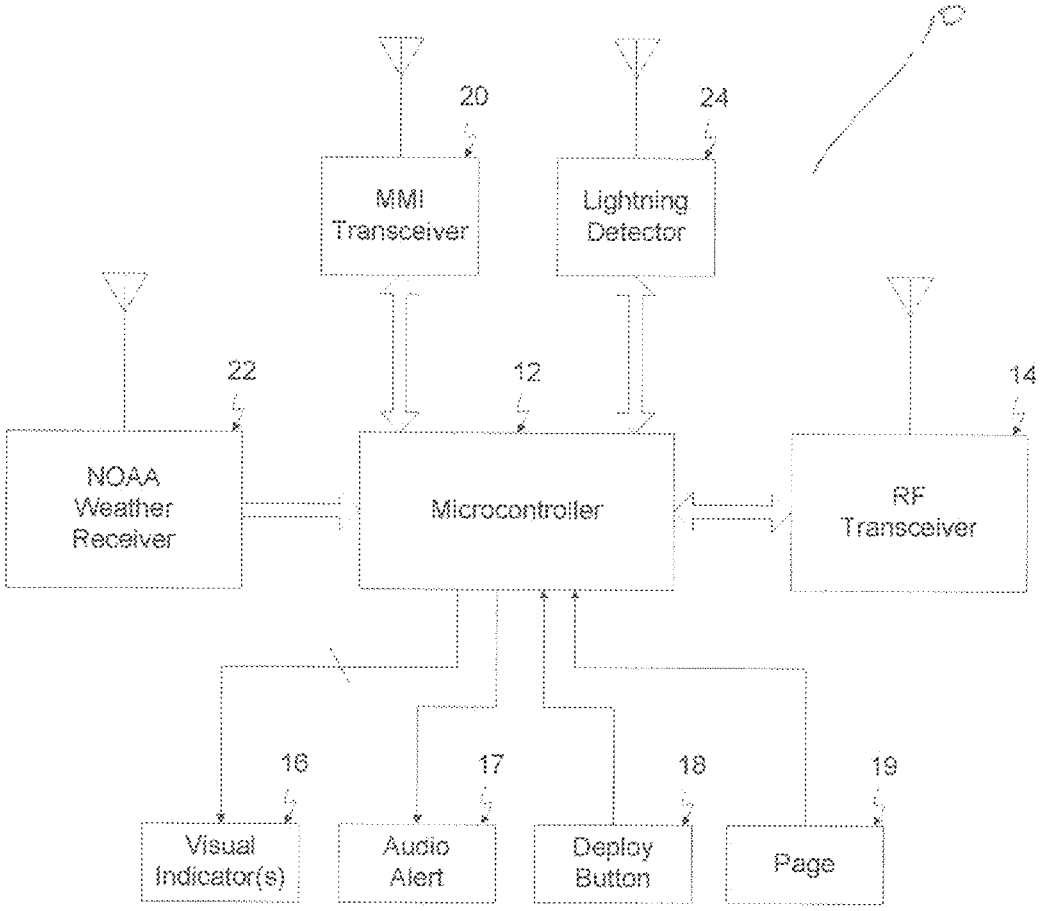
FIG. 3 illustrates the present invention comprising the base station component.

FIG. 3 illustrates the base station 10 having a first programmed controller 12, a radio frequency (RF) transceiver 14, visual indicator(s) 16, an audio alert 17, a deploy button 18, a page button 19 and a MMI transceiver 20. Optional embodiments of the base station 10 may also comprise enhancements such as an NOAA weather receiver 22 and lightning detector 24, wherein the weather receiver 22 is configured and dimensioned to receive information from NOAA (National Oceanic and Atmosphere Administration), and/or other information/data and/or commercially available information/data (re)broadcast or (re)transmitted for public use and/or information/data available via subscription based or aggregated service. The base station 10 is intended to communicate, bi-directionally, via RF means with a plurality of remote nodes 50.

Figure 4:
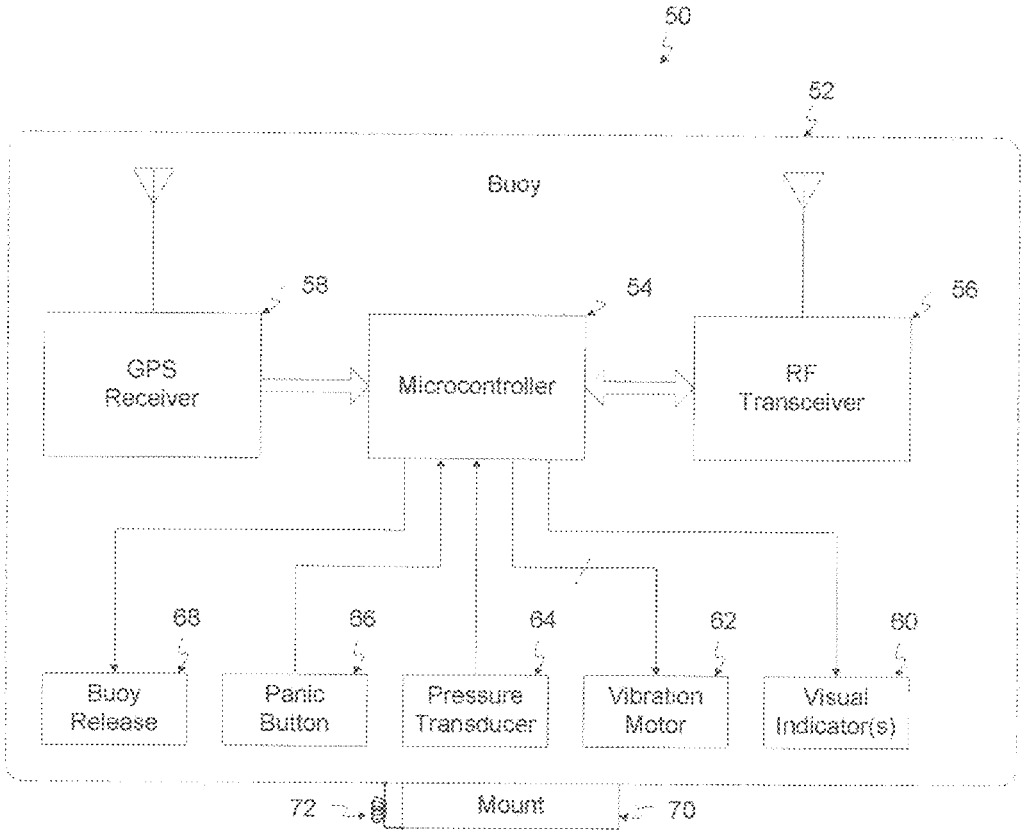
FIG. 4 illustrates the present invention comprising the monitee's component.

FIG. 4 illustrates the remote node 50 worn by an individual being monitored, e.g., the monitee, most commonly a swimmer. Wherein the node 50 comprises a buoy means 52 that is deployable and waterproof and includes the following: a programmed controller 54, a radio frequency (RF) transceiver 56, a GPS receiver 58, visual indicator(s) 60, an eccentric rotating mass (ERM) pager more commonly known as a vibration motor 62, a pressure transducer 64, a panic button 66, a buoy release mechanism 68 and a buoy mount 70. The deployable buoy means 52 and mount 70 are connected via a tether 72 which is intended to keep the deployable buoy 52 proximate to the mounting means 70 after release.

The mount 70 of the remote node 50 provides the monitee with a method to mount the device 50 on to the monitee's body, e.g. wrist, such as a wrist band or strap. The mount 70 and tether 72 should be of sufficient size and strength to allow support the pull of the deployable buoy 52 after deployment from its mount 70 as well as being capable of being submerged in fresh/salt water for extended periods of time.

The base station 10 and plurality of remote nodes 50 communicate bi-directionally under control of the microcontroller 12,54 using the contained RF transceiver 14,56. The RF transceivers 14,56 do not require any additional infrastructure for operation and are intended to communicate directly amongst the base station 10 and plurality of remote nodes 50. Since pursuit of a radio license would present an undue burden for most users, the preferred embodiment of the invention is intended to make use of the unlicensed portions of the RF spectrum as governed by local regulation. Within the United States, the Federal Communications Commission (FCC) is the governing body that regulates the RF spectrum. Portions of the unlicensed spectrum are dedicated to Industrial, Scientific, and Medical (ISM) applications and remote keyless entry (RKE) systems, It is envisioned that the invention will utilize a sub-1 GHz Short Range Device (SRIF) transceiver for license free operation below 1 GHz and more specifically the 433 MHz RKE band for its longer wavelength and distance capability. It must be noted that the present invention is not constrained to operation within these portions of frequency spectrum and may be adapted to other frequency bands as regulations/technology permit.

The base station 10 serves as the central coordinator of the invention. A second person, the monitor (e.g., a user such as a parent) would set up the base station 10 at a convenient location such as blanket near the edge of the beach where the first person, the monitee(s) or swimmer(s) will be in the water. Setup and configuration of the invention would utilize the MMI transceiver 20 to communicate with the personal communication device 80 and/or laptop 82 through the use of a wireless personal area network (PAN) technology such as Bluetooth™. The base station 10 would be paired with the personal communication device 80 and/or laptop 82 using a default ID and access code which is suggested to be personalized after initial pairing for security purposes. Once paired, a companion application (commonly called an 'app') could be executed on the personal communication device 80 and/or laptop 82 which would prompt the monitor to configure monitoring parameters identified herein as well as convey monitoring feedback of all remote nodes 50. While the RF transceivers 14,56 form their own PAN, this network operates at a lower frequency and at higher power allowing a larger monitoring area to be covered.

Direct use of Bluetooth™ for monitoring would be unsuitable for a swimmer safety network as most personal communication devices 80 and/or laptops 82 utilize low power class 2 (10 meter coverage) or class 3 (1 meter coverage) Bluetooth™ hardware which would severely limit the efficacy of the system.

Each remote node 50 within the defined network would have a unique identifier or serial number which would need to be paired with the base station 10 in a manner similar to that of Bluetooth™. The application software would remember previous monitee pairings (remote node 50) for ease of operation and remote nodes 50 can be enabled/disabled as well as added/deleted as part of configuration management of the invention. Since there exists the possibility of having a plurality of systems 1,101 located at the very same beach and even possibly an adjacent blanket, the present invention can employ a number of methods for addressing such scenario.

The first method of maintaining peaceful co-existence amongst a plurality of systems 1,101 would be through the use of addressing. Each remote node 50 would be assigned a specific address for communicating with the base station 10 and/or other remote nodes within its defined network. A limit of 254 remote nodes 50 has been arbitrarily selected based on an eight bit address which addresses 0 and 255 can be used for broadcast purposes (i.e. sent to all remote nodes 50 simultaneously). While in theory, the present invention could support an unlimited number of remote nodes 50, the polling loop time to communicate with each remote node 50 might be severely impacted and it is envisioned that a more practical limit is somewhere on the order of 10 remote nodes. Much in the way each remote node would be assigned an address, each system 1, 101 could be assigned an address to insure only the base station 10 and plurality of remote nodes 50 within a particular network communicate with each other.

A second method of maintaining peaceful co-existence amongst a plurality of systems 1,101 would be through the use of different frequencies. The frequency spectrum may be divided into sub-frequencies or channels. Each Swim-A-Sure system 1, 101 could operate on a different channel in a manner similar to Wi-Fi in an effort to maintain spectral harmony.

A third method of maintaining peaceful co-existence amongst a plurality of systems 1,101 would also employ sub-frequencies or channels. In this embodiment, instead of using a fixed or static frequency for communication, the base station 10 and plurality of remote nodes 50 would hop from frequency to frequency. Under frequency hopping conditions, both the base station 10 and plurality of remote nodes 50 must tune to the same frequency at the same time. This type of scheme typically employs a linear feedback shift register (LFSR) to create a pseudo random pattern frequency hopping pattern. The LFSR would be seeded with a unique identifier such a media access controller (MAC) address, serial number or the like and would sync up after the first or second transmission.

For real world operation, the system 1,101 would likely be configurable to employ any plurality of these methods in an effort to insure reliable communication within the defined network.

Once communication has been established amongst the base station 10 and all remote nodes 50, through the pairing procedure, monitoring of the remote nodes 50 can commence. The microcontroller 12 of the base station 10 would send a query out through the RF transceiver 14 on a periodic basis to monitor a swimmer's (e.g. monitee's) activity. The remote node 50 would receive the query through its own RF transceiver 56 and then be processed by the microcontroller 54. The microcontroller 54 would acknowledge the query by sending a response back through its own RF transceiver 56 to the base station 10. On the base station 10 the RF transceiver 14 would receive the acknowledgment and pass it along to the microcontroller 12 for processing.

In simplistic terms, the poll by the base station 10 query could simply mean 'Are you there?' with a response from the remote node 50 indicating 'Yes.' In a preferred embodiment, the remote node 50 employs a GPS receiver 58. When not communicating with the base station 10, the microcontroller 54 within the remote node 50 polls the GPS receiver 58 for location information and is constantly updated. In this embodiment, the base station 10 query could mean 'Where are you?' with the response from the remote node 50 indicating 'I am at XXX latitude and YYY longitude.' This information allows the application running on the personal communications device 80 and/or laptop 82 to superimpose location information for each remote node 50 on a map for optional tracking purposes.

The base station 10 polls each remote node 50 within its defined network on a periodic basis. The base station 10 will receive a response from the remote node 50 a large majority of the time, however, occasionally it will not for a variety of reasons (e.g., the monitee's are is underwater, a wave blocking the line of sight, or the monitee has strayed to the fringe of reception, etc.). A polling interval and missed response count are just some of the items which would be configurable for each monitee. Younger, less experienced, and/or even handicapped monitees would be polled more often whereas older or more experienced monitees would be polled less often to extend battery life. Similarly, the count of consecutive missed responses for each monitee is configurable based on monitee capability and experience. Setting these entries properly will provide the proper level of protection while keeping the number of false indications to a minimum.

The base station 10 is equipped with both visual indicating means 16 and an audio alert means 17 for signaling a possible safety situation. In the event the count of consecutive missed responses for a remote node 50 that has been set is exceeded, the visual indicator(s) 16 and audio alert 17 are used to signal a potential safety situation. Another configurable item would be to have the visual indicators 16 and an audio alert 17 continue sounding upon restoration of communication or continue sounding until manually disabled/silenced/attenuated by the individual operating the base station 10. This is just one level of monitoring feature of the present invention.

The base station 10 is also equipped with a paging means 19, such as a button, to get attention of all monitees within the defined network. Activation of paging means 19 is sensed by the microcontroller 12 and a broadcast message is sent to all remote nodes 50 via the RF transceiver 14. The remote node 50 receives the message via the RF transceiver 56 and is processed by microcontroller 54. The remote microcontroller 54 activates the visual indicating means 60 and vibration motor means 62 to alert the monitee wearing the remote node 50 of the page dispatched or communicated by the base station 10.

An enhanced embodiment of the present invention includes a circuit for monitoring NOAA weather broadcasts 22. This is particularly useful for lone monitee, e.g., swimmer such as a surfer, who may not be paying attention to incoming weather patterns. The NOAA maintains an emergency alert system broadcast on any one of seven (7) channel frequencies with the 162.40 MHz to 162.55 MHz range. These emergency alerts can be sensed and conveyed to any or all of the remote nodes 50 and would be configurable from the application running on the personal communications device 80 and/or laptop 82. On the base station 10, the visual indicating means 16 and audio alert means 17 could blink/sound a different pattern to distinguish between the various warning indications. Enhancements may include graphic indications of the warning type and/or recorded message playback instead of a simple annunciator sound.

Another alternate embodiment of the invention includes a lightning detector 24 for monitoring incoming lightning storms which is again useful for lone monitee such as a surfer who may not be paying attention to incoming weather patterns. Upon sensing lightning in the distance this information can be conveyed to any or all of the remote nodes 50 and would be configurable from the application running on the personal communications device 80 and/or laptop 82.

Figure 5:
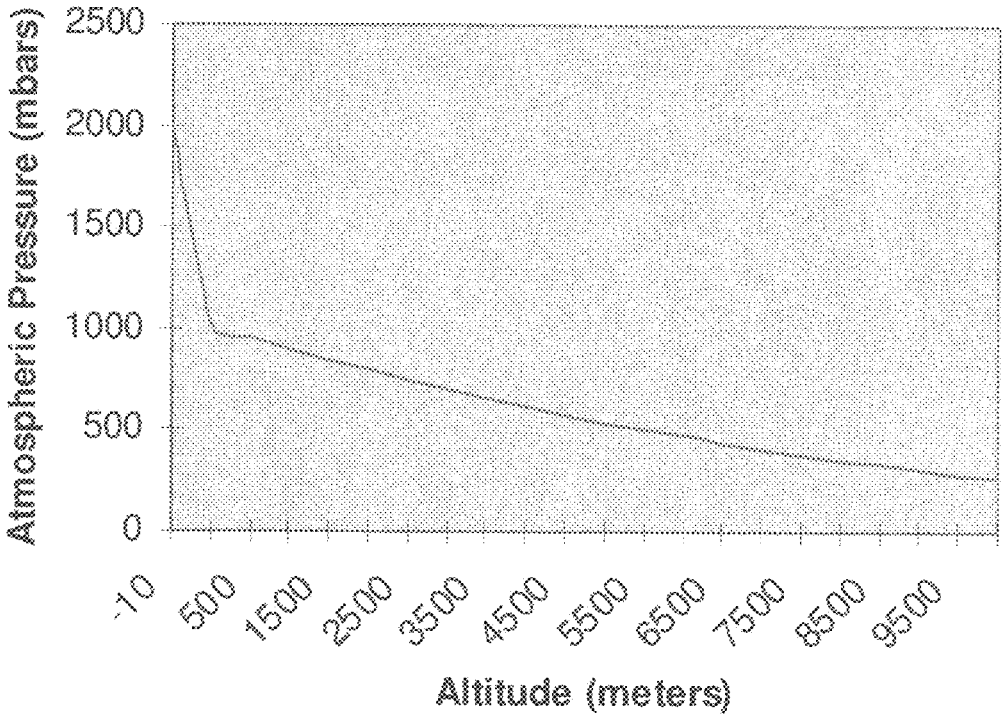
FIG. 5 reflects atmospheric pressure versus altitude.

One of the main features of the system 1,101 is the ability of the remote node 50 to automatically sense a potential drowning situation. Each remote node 50 is equipped with a pressure transducer means 64 to monitor atmospheric pressure. As illustrated in FIG. 5, the atmospheric range ranges from approximately 1014 mbars at sea level to 265 mbars at 10,000 meters above sea level (roughly the height of the Mount Everest, the highest mountain in the world). The 'knee' (sudden change) at the left side of the graph indicates the pressure experienced by going below sea level. The distinction must be made that any further reference below sea level is intended to mean physically under water as there are locations that can be below sea level yet not under water. For approximately every 10 meters below sea level the pressure increases by about 1,000 mbars due to the denser nature of water versus air. This phenomenon can be exploited for use within the present invention.

As each remote node 50 is powered up, a baseline atmospheric pressure reading is taken by the microcontroller 54 within each individual remote node 50. This baseline reading will vary by a very small percentage as a monitee (e.g., a swimmer) wanders around the swimming area. Upon entering the water though, the pressure will increase significantly as compared with the baseline reading. The microcontroller 54 within the remote node 50 constantly computes the ratio of the current atmospheric pressure to the baseline reading. The monitor (aka user) in charge of the monitoring the base station 10 has the ability to configure a threshold level that this ratio should not exceed (relating to depth underwater) as well as for how long (e.g., duration of time). Each threshold setting would be downloaded from the application on the personal communication device 80 and/or laptop 82 through the microcontroller 12 and RF transceiver 14 of the base station 10 before being received by the RF transceiver 56 and processed by the microcontroller 54 of each remote node 50. This allows each monitee to have a different set of thresholds that is independent of communication with the base station 10. By setting these thresholds a monitee can submerge to certain depths for certain periods of time without the microcontroller 54 flagging a possible drowning condition. As soon as either of these thresholds are exceeded, the microcontroller 54 of the remote node 50 signals the monitee using the visual indicator(s) means 60 and vibration motor means 62 to indicate that it will declare an emergency situation imminently. The period of time between warning the monitee and declaring an emergency would be a configured value that is downloaded to the remote node 50. If the monitee is not in danger of drowning, the monitee should rise to the surface as quickly as possible (and within the time configured) to prevent the remote node 50 from declaring an emergency situation.

A key feature of the present invention is that a monitee can be proactive, e.g., when the monitee believes themselves to be in trouble, the monitee can press a panic button 66 mounted on the remote node 50. Upon pressing and holding this button 68 for a defined period of time, the monitee can also declare an emergency situation. This period of time would be a configured value that is downloaded to the remote node 50. Upon the remote node 50 having declared an emergency situation either via pressure monitoring means 64 set forth hereinabove or via the panic button 66, the microcontroller 54 signals a buoy release mechanism 68 to release the buoy 52 from its mount 70. By doing so, the electronics of the remote node 50 can remain floating on the surface of the water to signal the base station 10 while staying proximate to the monitee via the tether 72. After deployment/release the remote node 50 sends an endless series of messages to the base station 10 to indicate an emergency situation. In a preferred embodiment, these messages contain location information from the GPS receiver 58 so that the monitee's location can be identified and updated in real-time. The base station 10 upon receiving an emergency message from any of the remote nodes 50 within the defined network would signal the emergency condition through the visual indicator(s) 16 and audio alert 17.

Referring back to the earlier situation whereby the count of consecutive missed responses has been exceeded, the monitor at the base station 10 can escalate the situation to emergency status as well. In this instance the monitor at the base station 10 would scan the swimming horizon for the 'missing' monitee who may simply be out of range, submerged briefly or had RF signal blocked by a wave, dock, etc. If the monitee is not sighted, this monitor can press a deploy button 18 that would send an endless series of messages to the 'missing' remote node 50 to deploy its buoy. In the embodiment equipped with optional GPS tracking, the last known transmission would be superimposed on a map of the application running on the personal communication device 80 and/or laptop 82 so further searching can commence.

Furthermore, the system 1 can be configured to provide safety automatically, in the situation when the monitee is swimming alone, e.g. a surfer, or when the monitee strays past the warning period set forth hereinabove, and the monitor is not paying attention for some other reason, whether justified or not. For instance, the base station 10 provides means for setting a second predetermined time interval, wherein said deployment means 18 is automatically deployed if neither the monitee nor the monitor activate said deployment means 18 or 66; by sending an endless message from the base station 10 to the remote node 50 to activate the buoy release means 68. This would function as a further backup system to increase the safety of the monitee. Although this system 1 can be used for swimmers, it is envisioned that it can be implemented in scenarios as for young and older individuals that partake in activities near the water, e.g., fishing off a dock, boat, etc. These monitees, namely, the fisherman have no intention of going into the water, however, for various reasons, they may find themselves in water, e.g., slip and fall, heart attack, faulty railing about the perimeter of the dock or pier, and this system would provide a locating device for the monitor of the base station 10 inside the cabin, tent, etc. at a nearby base camp, whatever that may be.

Segueing further in the scenario of the lone monitee (e.g., a surfer), the present invention could be configured to initiate a phone call or text to emergency personnel by dialing/texting 9-1-1 (here in the United States) or another number that has been configured earlier utilizing the MMI transceiver 20 and personal communications device 80 and/or laptop 82. However, it should be noted that this scenario does require that Wi-Fi and/or cellular service is available in the monitor's location.

The present invention is not limited to beach or swimming use, as the system is envisioned and designed to be utilized in a camping situation to insure youngsters or cognitively impaired individuals do not wander too far from the base station 10 (campsite). Under these conditions the buoy release mechanism 68 of the remote nodes 50 would be disabled or configured differently as it would serve no useful purpose unless there is water nearby. This would be a downloaded configurable item as well.

All the above referenced patents; patent applications and publications are hereby incorporated by reference. Having this described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and is not limiting. The invention is limited only as defined in the claims and equivalents thereto.

The invention claimed is:

1. An interactive life system for increasing the safety of a person in water comprising;

a base station having a first controller and a first RF transceiver for communicating bi-directionally with a second controller and second RF transceiver of a remote node;

said base station operated by a monitor having a first visual means, an audio alert means, a deployment means, and paging means cooperatively connected together;

said remote node worn by a monitee having a buoy means attached to a mounting means and having a tether connecting said mounting means and said buoy means together;

said buoy means housing said second controller and second RF transceiver, along with a second visual means, vibrating means, pressure transducer means, panic means, buoy release means, and GPS means cooperatively connected together;

wherein said deployment means includes a button that sends a continuous message to said remote node to deploy said buoy means.

2. An interactive life system as in claim 1, wherein each visual means includes a light.

3. An interactive life system as in claim 1, wherein said GPS means tracks the last known transmission from said remote node which may also be superimposed on a map running on a personal communication device and/or laptop.

4. An interactive life system as in claim 1, wherein said system further includes a weather receiver.

5. An interactive life system as in claim 1, wherein said system further includes a lightning detector.

6. An interactive life system as in claim 1, wherein said paging means provides said base station with means to page said remote node.

7. An interactive life system as in claim 1, wherein said pressure transducer means monitors atmospheric pressure, wherein said pressure transducer:

senses atmospheric pressure upon power up which is characterized as a pressure baseline, continuously senses the actual atmospheric pressure of the remote node while powered on;

wherein said second controller compares the actual pressures sensed with a pressure set point defined by the base station, when said pressure comparison yields a result that exceeds the acceptable pressure set point, the second controller signals the monitee via second visual means and vibration means thereby providing the monitee with a predetermined time interval to get back into compliance, else said node notifies the base station of the non-compliant pressure reading and duration thereof; wherein said time interval is set by the base station by the monitor.

8. An interactive life system as in claim 1, wherein said panic means provides a button for the monitee to touch when the monitee is on the cusp of needing assistance; wherein said button causes the second microcontroller to signal the buoy release means 68 to release the buoy means 52 from mounting means 70 while remaining tethered, wherein said node transmits an endless message to the base station indicating an emergency situation via said first visual means 16 and audio alert means 17.

9. An interactive life system as in claim 1, wherein base station provides means for setting a second predetermined time interval, wherein said deployment means is automatically deployed if neither the monitee nor the monitor activate said deployment means; by sending an endless message from the base station to the remote node to activate the buoy release means.

* * * * *